US005180865A

United States Patent [19]

Heilman et al.

[11] Patent Number: 5,180,865

[45] Date of Patent: Jan. 19, 1993

[54] BASE OIL FOR SHEAR STABLE MULTI-VISCOSITY LUBRICANTS AND LUBRICANTS THEREFROM

[75] Inventors: William J. Heilman, Houston; Clifford G. Venier, The Woodlands, both of Tex.

[73] Assignee: Pennzoil Products Company, Houston, Tex.

[21] Appl. No.: 802,980

[22] Filed: Dec. 6, 1991

[51] Int. Cl.[5] ..... C10M 107/08

[52] U.S. Cl. ..... 585/10; 585/12

[58] Field of Search ..... 585/10, 12

[56] References Cited

U.S. PATENT DOCUMENTS

| | | | |
|---|---|---|---|
| 2,130,507 | 9/1938 | Otto et al. . | |
| 3,838,049 | 9/1974 | Souillard et al. | 585/10 |
| 3,860,522 | 1/1975 | Fischer et al. . | |
| 3,860,522 | 1/1975 | Fischer et al. . | |
| 4,022,590 | 5/1977 | Morduchowitz et al. . | |
| 4,031,020 | 6/1977 | Sugiura et al. . | |
| 4,194,057 | 3/1980 | Brankling et al. . | |
| 4,218,330 | 8/1990 | Shubkin . | |
| 4,263,465 | 4/1981 | Sheng et al. . | |
| 4,299,714 | 11/1981 | Sugiura et al. . | |
| 4,481,122 | 11/1984 | Root et al. . | |
| 4,507,515 | 3/1985 | Johnston et al. . | |
| 4,601,840 | 7/1986 | Zehler et al. . | |
| 4,613,712 | 9/1986 | Bridger . | |
| 4,620,048 | 10/1986 | Ver Strate et al. . | |
| 4,721,823 | 1/1988 | Venier et al. . | |
| 4,788,362 | 11/1988 | Kaneko | 585/10 |
| 4,912,272 | 3/1990 | Wu | 585/10 |
| 4,956,122 | 9/1990 | Watts et al. | 585/12 |
| 4,956,122 | 9/1990 | Watts et al. . | |
| 5,089,156 | 2/1992 | Chrisope et al. | 585/12 |

OTHER PUBLICATIONS

Thomas et al., "Industrial and Engineering Chemistry", vol. 32, No. 3, pp. 299–304, 1940.

Souillard, "Proceedings of Isle-Asle International Conference", pp. 724–737.

Wright et al., "General Relationships for Polymer-Petroleum Oil Blends", I&EC Product Research and Development, 1964, pp. 153–158.

Dieter Klamann, "Lubricants and Related Products", Verlag Chemie, 1984, pp. 101, 188 and 192.

Otto et al., "Motor Oils Having Viscosity Index of 120 Predicted as Definite Need", The Oil and Gas Journal, Nov. 15, 1984, pp. 98–106.

Loza et al., "Comparative Testing of Lubricants for Sliding Bearings of Vignetting Machines", Probl. Treniya Iznashivaniya, vol. 10, 1976, pp. 85–89 (An original Russian Inventor Certificate 577,220) Russian Document (1970), No. 2.

*Primary Examiner*—Jacqueline Howard

*Attorney, Agent, or Firm*—Lowe, Price, LeBlanc & Becker

[57] ABSTRACT

Fully synthetic lubricating base oil compositions are formulated from blends of 50–97 wt % of synthetic hydrocarbons and 3–50 wt % isobutylene oligomers. The lubricating base oil compositions have constant viscosity indexes which are higher than those of the components used to form the compositions. The synthetic hydrocarbon and isobutylene oligomers are combinable in various amounts with conventional additives to form multi-grade engine lubricants, which are shear stable.

4 Claims, No Drawings

BASE OIL FOR SHEAR STABLE MULTI-VISCOSITY LUBRICANTS AND LUBRICANTS THEREFROM

TECHNICAL FIELD

The present invention relates to fully synthetic lubricating base oil compositions and lubricants formulated from them. In particular, the present invention relates to lubricating base oil compositions comprising synthetic hydrocarbons in combination together with low to medium molecular weight isobutylene oligomers and lubricants formulated therefrom.

BACKGROUND ART

Lubricating oils are normally classified in terms of their viscosity at some standard temperature. Equally important is a property known as the viscosity index, which is a widely used and accepted measure of the variation in kinematic viscosity due to changes in the temperatures of a petroleum product between 40° and 100° C. (ASTM D2270-86). For an oil to satisfy viscosity requirements optimally at both extremes of a useful temperature range to which it may be subjected, a high viscosity index is necessary. This property can be controlled to some extent by refining, but in recent years the trend has been towards formation of multi-grade oils of extremely high viscosity indexes in which certain polymer compounds which function as viscosity index improvers are added.

While the viscosity index of synthetic lubricating oils can be usefully modified by the addition of oil-soluble polymeric viscosity index (V.I.) improvers, such an addition can introduce chemical instability to the lubricating compositions.

In the industry there is an ever-increasing demand for lubricating compositions showing good flow at low temperatures, yet possessing adequate viscosity at higher temperatures. The lubrication of engines and gears is usually carried out with multi-grade oils based on mineral lubricating oils whose viscosity/temperature characteristic are influenced by the addition of polymers, such as V.I. improvers, such that the classifying features of the SAE oils for winter and summer use respectfully are combined in a single oil.

The performance of such multi-grade oils based on a mineral oil is highly unsatisfactory for a number of reasons. If the amount of the V.I. improvers, e.g., polyacrylates, polymethacrylates, olefin copolymers, added is to remain within tolerable limits, the additional use of paraffinic base oils is inevitable. Cooling of the oils causes the pour point to be reached as a result of the crystallization of solid paraffins. Although the pour point may be lowered by the addition of pour point depressants, the viscosities in the range between the turbidity point and the pour point remain higher than anticipated for the liquid phase due to the aggregation of crystallizable paraffin components. Distinct differences may be observed between the low temperature viscosity calculated by extrapolation of viscosity measurements made at higher temperatures and the low temperature viscosity as actually measured. This increased viscosity greatly restricts the range of application of such oils.

Moreover, such multi-grade oils containing V.I. improvers are not stable to the action of shearing forces encountered under operating conditions. The resulting decrease in viscosity at all temperatures and reduction of the viscosity index impairs the viscosity/temperature characteristic and the original multi-grade character of the oils may be lost.

Synthetic oils, particularly synthetic hydrocarbons, have become widely accepted as replacements for mineral oils and have proven to be interesting lube bases which can be used in many applications.

Polybutenes are known to the art as synthetic, paraffinic hydrocarbons produced by a simple process from readily available feedstocks. Polybutenes are known to be used as lubricants and are oligomers with molecular weights varying between 300 and 3,000 excluding the very viscous derivatives (molecular weights from 20,000 to 100,000) which are used as V.I. improvers and derivatives of even higher molecular weight which are synthetic rubbers. Polybutenes, unfortunately, exhibit high viscosity and high volatility when compared to other synthetic hydrocarbons of the same molecular weight.

The use of polybutenes in synthetic lubricants is described, for example, in U.S. Pat. Nos. 4,299,714 and 4,031,020 to Sugiura et al. These patents disclose fluid systems containing polybutenes of a molecular weight of 100-500, polyalphaolefins of a molecular weight of 100 to 500, mineral oil and additives. The products of this patent, however, appear to be of too low viscosity (5.5 cSt at 210 degrees F.) for use as lubricating oils in internal combustion engines or diesel engines.

U.S. Pat. No. 4,194,057 to Brankling et al. discloses polymer compositions suitable for uses of viscosity improver additives in lubricating oil compositions which include polybutenes of molecular weight 5,000 to 60,000 to prevent gelling of the viscosity improver additive concentrates. Similarly U.S. Pat. No. 4,620,048 to Ver Strate et al. discloses hydrocarbon solutions which contain polybutenes as viscosity index improvers for mineral fluid oils.

U.S. Pat. No. 3,860,522 to Fischer disclose synthetic lubricants which consist of mixtures of esters of branched-chained dicarboxylic acids and aliphatic alcohols with polymers of butenes which have a molecular weight of 1,200 to 4,500. This patent requires that the polybutenes always be mixed with the synthetic ester lubricants disclosed. The accomplishment of some of the objectives of this patent using PAO of viscosities from 40 to 1000 cSt at 100° C. is disclosed in U.S. Pat. No. 4,956,122 to Watts. However, use of these high viscosity PAO's leads to inferior performance such as in Caterpillar diesel engine tests.

In the publication by Thomas et al., entitled "Polybutenes," Industrial and Engineering Chemistry, Volume 32, No. 3, page 299–304, there is a discussion of the use of polybutenes as additives in the production of various petroleum products such as motor oil to improve the viscosity index of the oil. This publication discloses polybutenes of variable molecular weights and characteristics of such polybutenes including blends thereof with asphalts and paraffin wax.

In the publication by Souillard, "The Use of Polybutenes in Lubrication," Proceedings of the ISLE-ASLE International Conference" 1975, page 724 to 737, polybutenes are disclosed which have a molecular weight of 300–1,000 with viscosities similar to mineral oils. These polybutenes are discussed as being industry lube bases which can be used in many applications.

The present invention is an improvement over prior known lubricating compositions and provides for fully synthetic lubricating base oil compositions which exhibit a high viscosity index to provide lubricants ranging from less viscous to more viscous multi-grade motor oils.

SUMMARY OF THE INVENTION

It is accordingly one object of the present invention to provide fully synthetic lubricating base oil compositions which in many useful cases demonstrate a high viscosity index which allows for a wide range of multi-grade motor oils.

A further object of the present invention is to provide for fully synthetic lubricating compositions which are much more shear stable than conventional synthetic hydrocarbon products.

Another object of the present invention is to provide for fully synthetic lubricating compositions which can be used as cross graded, multi-weight or multi-grade oils without the use of conventional viscosity index improvers.

Another objective of the present invention is to provide for fully synthetic lubricating compositions which are higher viscosity engine oils, e.g., SAE 15W40, 20W-50, and even 25W-50.

According to the present invention there are provided fully synthetic lubricating base oil compositions formulated using combinations of low viscosity components and high viscosity components. In particular, the lubricating base oil compositions of the present invention are formulated to comprise 50 to 97 weight percent of a low viscosity component, preferably a synthetic hydrocarbon base oil, such as a polyalphaolefin or alkyl cyclopentane and about 3 to 50 weight percent of a high viscosity component, preferably a low to medium molecular weight isobutylene oligomer. The finished oil formulation may also contain up to 25 weight percent of additives, preferably 0.1–5.0 weight percent, and optionally, an ester.

DESCRIPTION OF PREFERRED EMBODIMENTS

The synthetic lubricating base oil compositions of the present invention comprise a combination of a low viscosity component and a high viscosity component. These components are combined in proportions comprising about 50 to 97 weight percent of the low viscosity component and about 3 to 50 weight percent of the high viscosity component. The low viscosity component can be any synthetic hydrocarbon which has lubricating characteristics and the appropriate viscosity. Normally such materials are referred to as base oils. The preferred low viscosity component for use in the present invention is a polyalphaolefin. Polyalphaolefins are well known in the art and need not be further described here. Synthetic lubricant compositions comprising alkylated cyclopentanes, alkylated cyclopentadienes and/or alkylated cyclopentenes, as described in U.S. Pat. No. 4,721,823 of Venier et al may also be used as the base oils. The disclosure of this prior U.S. Pat. No. 4,721,823 is incorporated herein by reference with respect to the description of the alkylated cyclopentanes, alkylated cyclopentadienes and alkylated cyclopentenes which may be used in the invention. Alkylated benzenes and alkylated cyclohexanes both of which are well known in the art, may also be used as the low viscosity base oil.

A special feature of the invention is the high viscosity component which comprises certain isobutylene oligomers which have molecular weights in the range of 900 to 6,000. This molecular weight is a lower molecular weight than conventional viscosity index improvers.

These oligomers comprise compositions in which the predominant amounts are referred to herein as oligomers of isobutylene. Oligomers of isobutylene are available commercially and may be purchased from Amoco Oil Company under the trade name INDOPOL or from Exxon Paramins under the trade name PARAPOL and under the trade name HYVIS.

According to the present invention the overall lubricant formulation includes between about 3 to about 50% by weight of high viscosity isobutylene oligomer component and about 50 to about 97% by weight of the low viscosity base oil synthetic hydrocarbon. Within this range the resulting lubricant base oils have been found to demonstrate a consistent viscosity index characteristic of the components and not of their relative proportions, thus indicating an unexpected synergistic effect. The ability to combine the components over the above ranges, while maintaining a constant viscosity index, enables the production of blended lubricants ranging in viscosities from 0W-20 motor oil (100° C. kinematic viscosity=5.6 to 9.3 cSt), to 25W-60 motor oil (100° kinematic viscosity=21.1 to 26.1 cSt).

In addition, because the molecular weight of the more viscous components is 900–6,000, the compositions are much more shear stable than similar synthetic hydrocarbon products thickened with conventional high molecular weight polymers. It has further been discovered that cross-grade oils, e.g., 5W-30, can be blended without the use of conventional viscosity improvers. Even without the inclusion of additional viscosity improvers, the lubricating formulations exhibit viscosity indexes from about 130 to about 190.

In a preferred embodiment the lubricating oil of this invention comprises between about 50 and about 97% by weight of the synthetic lubricating base oil such as polyolefin and between about 3 and about 50% by weight of the isobutylene oligomer. Within this range lubricating compositions have been formulated which have viscosities between about 5.6 cSt (kinematic viscosity at 100° C.) and about 30.0 cSt. Based on the compatibility of the components and the achievable wide range of viscosities, the synthetic lubricating base oil compositions according to the present invention can be used to produce multi-grade engine lubricants, multi-grade axle lubricants, multi-grade transmission lubricants and multi-grade gear lubricants.

In formulating the lubricant compositions of the invention, it is also usually preferable to include up to 25 weight percent of conventional additives, preferably about 0.1 to 5 weight percent. Conventional additives include pour point depressants, viscosity index improvers, corrosion inhibitors, antioxidants, and other additives conventionally known to the lubricant art. The lubricating compositions of the present invention may be used in internal combustion engines which operate on gasoline. They are also useful for diesel engines. The lubricating oils of the invention demonstrate excellent shear stability in use in such engines and unexpectedly good performance in Caterpiller Engine Tests compared to a high viscosity polyalphaolefin thickener.

The following examples are presented to illustrate the invention but the invention is not to be considered as being limited thereto. In the examples and throughout the specification, parts are by weight unless otherwise indicated.

EXAMPLE 1

Blends of polyalphaolefins (PAO ) or alkylcyclopentanes with various polybutenes showed the property that the viscosity index of the base oil mixture depended on the nature of constituents rather than on the concentration of the thickener, as expected. The following Table shows representative data. The viscosity indexes of the PAO—Butene oligomer base oil are constant when 10% of the mixture is the butene oligomer. The value of the viscosity index seems to depend only on the degree of polymerization of the butene oligomer.

TABLE 1

VISCOSITY INDEXES OF SYNTHETIC HYDROCARBON-BUTENE OLIGOMER BASE OILS

| Synthetic Hydrocarbon | Synthetic Hydrocarbon Viscosity, 100° C. | Butene Oligomer | Butene Oligomer Viscosity, 100° C. | Viscosity Index % Butene Oligomer 0 | 5 | 10 | 15 | 20 | 25 |
|---|---|---|---|---|---|---|---|---|---|
| PAO 4 | 3.8 cSt | Indopol H-300 | 700 cSt | 120 | 131 | 141 | 142 | 143 | 142 |
| PAO 4 | 3.8 cSt | Parapol 2200 | 3200 cSt | 120 | 142 | 155 | 159 | 158 | 156 |
| PAO 4 | 3.8 cSt | Parapol 2500 | 4400 cSt | 120 | 145 | 158 | 162 | 161 | — |
| PAO 4 | 3.8 cSt | Hyvis 600 | 14000 cSt | 124 | 157 | 169 | 172 | 172 | 174 |
| PAO 6 | 5.8 cSt | Indopol 1500 | 3400 cSt | 135 | 144 | 147 | 146 | — | — |
| Alkylcyclo- | 5.2 cSt | Parapol 2500 | 4400 cSt | 134 | — | 161 | 160 | 160 | — |

EXAMPLE 2

The viscosity of some synthetic hydrocarbon-butene oligomer base oils is high enough to allow severely cross-graded products to be blended without V.I. improvers. The Table 2 gives some examples of 5W-30 engine oils blended without viscosity index improvers using commercially available Dispersant-Inhibitor (DI) packages. Table 3 gives some examples of heavier multi-viscosity oils. If just the low viscosity synthetic hydrocarbon were used, a polymeric viscosity index improver would have been necessary to achieve the low temperature and high temperature viscosity requirements of the 5W-30 oil simultaneously.

TABLE 2

SAE 5W-30 OILS BLENDED WITH SYNTHETIC HYDROCARBONS AND BUTENE OLIGOMERS WITHOUT VISCOSITY INDEX IMPROVERS

| | 1 | 2 | 3 |
|---|---|---|---|
| Synthetic Hydrocarbon | PAO 4 | Alkylcyclopentane | PAO 4 |
| % in Base Oil | 88 | 92 | 91 |
| Butene Oligomer | Parapol 2500 | Parapol 2500 | Hyvis 600 |
| % in Base Oil | 12 | 8 | 9 |
| DI Package* | Amoco 1 | Amoco 2 | Lubrizol |
| Kinematic Viscosity, 100° C., cSt | 10.0 | 10.3 | 11.4 |
| CCS Viscosity, −25° C., cP | 3325 | 3200 | 3300 |

*USED AT MANUFACTURERS SUGGESTED TREAT RATE.

TABLE 3

HEAVY MULTI-VISCOSITY OILS BLENDED WITH SYNTHETIC HYDROCARBONS AND BUTENE OLIGOMERS WITHOUT VISCOSITY INDEX IMPROVERS

| | 1 | 2 | 3 |
|---|---|---|---|
| Synthetic Hydrocarbon | PAO 4 | PAO 6 | PAO 4 |
| % in Base Oil | 85 | 75 | 60 |
| Butene Oligomer | Parapol 2500 | Indopol H-300 | Indopol H-300 |
| % in Base Oil | 15 | 25 | 40 |
| DI Package* | Amoco | Lubrizol | Amoco |
| SAE Grade | 15W-40 | 20W-50 | 25W-50 |
| Kinematic Viscosity, 100° C., cSt | 15.3 | 16.5 | 19.1 |
| CCS Viscosity, −15° C., cP | 3175 | | |
| CCS Viscosity, −10° C., cP | | 3400 | 4850 |

*USED AT MANUFACTURERS SUGGESTED TREAT RATE.

EXAMPLE 3

The absence of high molecular weight viscosity index improvers imparts improved shear stability to the finished oil product and prevents the degradation of viscosity. Table 4 shows a comparison of permanent shear loss for butene oligomer thickened oil and conventional thickened oils in the Fuel Injector Shear Stability Test (FISST, ASTM D3945). The polybutene thickened oil exhibits minimal shear loss of viscosity at 100° C. while the commercial product and a polymer thickened oil lose 8% and 14.5%.

TABLE 4

SHEAR STABILITY OF MULTI-VISCOSITY OIL BLENDED WITH PAO-BUTENE OLIGOMER BASE OIL

| Oil | 100° C. Viscosity, cSt Before FISST | After FISST | % Shear Loss |
|---|---|---|---|
| PAO 4/Parapol 2500 | 11.71 | 11.62 | 0.8 |
| Mobil 1 | 10.93 | 10.05 | 8.0 |
| PAO 4/Acryloid 954 | 11.86 | 10.14 | 14.5 |

EXAMPLE 4

In this example formulations according to the invention were evaluated in a Scote engine performance test. Scote is a Single Cylinder Oil Test Engine. In this Caterpillar 1G2 and 1K engine test, the engine predicts the performance of an engine oil formulation. Two identical SAE-50 motor oils were formulated except that one oil was thickened with a polyalphaolefin (PAO 40) and the other oil was thickened with an isobutylene oligomer, H-100, obtained from Amoco Oil Company. The data on the compositions, physical properties and engine tests are shown in the following Table 5.

The difference in performance between the two oils was substantial. The engine test gave Cat. 1G2 weighted total demerits (WTD) of 270 for the isobutylene oligomer oil and 1456 for the polyalphaolefin 40 oil. The maximum weighted value for prediction of a caterpillar 1G2 pass is 1100. The 1G2 predicted passing value for the 1K engine must be less than 240 (WD-1). The WD-1 value for the PIB oil was 224 and 1948 for the polyalphaolefin oil. Thus the polyalphaolefin oil did not perform satisfactorily at the Cat. 1G2 nor the Cat. 1k level whereas the isobutylene oligomer oil performed surprisingly well in both. The table is as follows. In the table Emery 2971 is di(isotridecyl)adipate. HiTEC 2990 is a commercially available dispersant-inhibitor package. HiTEC 4702 and Irganox L-57 are antioxidants.

TABLE 5

PRELIMINARY COMPARISON OF ENGINE PERFORMANCE OF SAE 50 SYNTHETIC OILS

| | A PIB Oil | B PAO 40 Oil |
|---|---|---|
| Component | | |
| PAO 6 | 37.0% | 22.0% |
| Emery 2971 | 15.0% | 15.0% |
| HiTEC 2990 DI | 10.0% | 10.0% |
| HiTEC 4702 Antiox | 0.5% | 0.5% |
| Irganox L-57 Antiox | 0.5% | 0.5% |
| Indopol H-100 PIB | 37.0% | — |
| PAO 40 | — | 52.0% |
| Physical Properties | | |
| Vis, 100° C. (ASTM D445) | 18.8 cSt | 18.4 cSt |
| Vis, 40° C. (ASTM D445) | 184 cSt | 144 cSt |
| Vis Index | 115 | 143 |
| CCS, −10° C. (ASTM D2602) | 7300 cP | |
| CCS, −15° C. (ASTM D2602) | 12,600 cP | |

TABLE 5-continued

PRELIMINARY COMPARISON OF ENGINE PERFORMANCE OF SAE 50 SYNTHETIC OILS

| | A PIB Oil | B PAO 40 Oil | |
|---|---|---|---|
| MRV, −20° C. (ASTM D2602) | 24010 cP | | |
| TBS, 150° C. (ASTM D2602) | 5.2 cP | | |
| Noack Volatility (DIN 5) | 5.9% | 3.9% | |
| ENGINE TEST | | | |
| Weight Total Demerits (WDT) | 270 | 1456 | CAT. 1G2 pass predicted if <1100 |
| Weight Demerits (WD-1) | 224 | 1948 | 1K pass predicted if <240 |

The invention has been described herein with reference to certain preferred embodiments. However, it is obvious that since variations thereon will become apparent to those skilled in the art, the invention is not to be considered as limited thereto.

What is claimed is:

1. A fully synthetic lubricating composition consisting essentially of:

(a) about 50–97 weight percent of a synthetic hydrocarbon selected from the group consisting of a poly-alphaolefin, an alkylated cyclopentane, an alkylated cyclopentadiene, an alkylated cyclopentene, an alkylated benzene, and alkylated cyclohexane, or mixtures thereof;

(b) about 3 to 50 weight percent of isobutylene oligomer, said isobutylene have a molecular weight of about 900 to 6,000, and a higher viscosity than said synthetic hydrocarbon, and (c) up to about 5 weight percent of a lubricating additive, wherein the lubricating additive is selected from the group consisting of pour point depressants, viscosity index improvers, corrosion inhibitors, antioxidants, and mixtures thereof.

2. A fully synthetic lubricating base oil composition according to claim 1, wherein said synthetic hydrocarbon comprises a polyalphaolefin.

3. A fully synthetic lubricating base oil composition according to claim 1, wherein said synthetic hydrocarbon is selected from the group consisting of an alkylated cyclopentane, an alkylated cyclopentadiene, an alkylated benzene, and alkylated cyclohexane, and an alkylated cyclopentene.

4. A full synthetic lubricating composition according to claim 1, wherein said lubricating composition has a viscosity between about 5.6 cSt (kinematic) and 30 cSt at 100° C.

* * * * *